US005904433A

United States Patent [19]

Kay

[11] Patent Number: 5,904,433

[45] Date of Patent: May 18, 1999

[54] FLUID APPLICATOR AND DISPENSING SYSTEM FOR CONTROLLING FLUID AND VAPOR FLOW

[76] Inventor: Nathan Kay, 375 El Portal, Palm Springs, Calif. 92264-8908

[21] Appl. No.: 08/965,358

[22] Filed: Nov. 6, 1997

Related U.S. Application Data

[60] Provisional application No. 60/030,450, Nov. 6, 1997.

[51] Int. Cl.[6] ..... A46B 17/04

[52] U.S. Cl. ..... 401/269; 401/202; 401/205

[58] Field of Search ..... 401/269, 202, 401/206, 205, 207, 208, 277, 280, 288, 276, 124, 102; 15/164.3, 167.1

[56] References Cited

U.S. PATENT DOCUMENTS

| | | | |
|---|---|---|---|
| 4,368,746 | 1/1983 | Spatz | 132/88.5 |
| 4,748,990 | 6/1988 | Brown et al. | 132/79 A |
| 5,259,682 | 11/1993 | Uchiyama | 401/277 |
| 5,397,195 | 3/1995 | Goncalves | 401/277 |

*Primary Examiner*—David J. Walczak
*Attorney, Agent, or Firm*—Cohen, Pontani, Lieberman & Pavane

[57] ABSTRACT

The inventive fluid dispenser includes a container in which the fluid to be dispensed is stored and an attached brush-type applicator from which the stored fluid may be selectively applied to a work surface. The container has an open end to which an applicator housing is attached and which carries a bristled brush. An insert disposed within the applicator housing defines passageways through which stored fluid is deliverable from the container to the applicator housing. The fluid-delivery passageways are automatically closed when an associated cap is detachably positioned about the brush-carrying end of the dispenser through deformation or displacement of the applicator housing to prevent the unintended delivery of stored fluid into the applicator housing during periods of nonuse. The insert may also include a vapors-release passageway extending between the container and the applicator housing for venting vapors into the brush-enveloped cap and thereby prevent drying out of the brush during periods of nonuse. The vapors-release passageway is closeable by a check valve against the unintended flow of stored fluid therethrough.

24 Claims, 4 Drawing Sheets

FLUID APPLICATOR AND DISPENSING SYSTEM FOR CONTROLLING FLUID AND VAPOR FLOW

This ia a Provisional application No. 60/030,450, filed Nov. 6, 1997.

FIELD OF THE INVENTION

The present invention relates to a fluid applicator and dispensing system that combines an applicator tip and fluid-storage container in a hand-held dispenser. More specifically, the present invention relates to an applicator and dispensing system which is operable for controlling the flow of the stored fluid product from the container, preventing inadvertent or accidental flow of stored fluid from the container when the cap is on, permitting the flow of fluid-emitted or associated vapors or gasses from the fluid in the container to the applicator tip while simultaneously preventing the flow of stored fluid through the applicator, and preventing drying out of the applicator tip after use or during periods of nonuse.

BACKGROUND OF THE INVENTION

There have been numerous efforts to market a product for dispensing a volatile fluid from a container through an applicator that is attached to the container. These attempts have failed or produced only marginally satisfactory products. None of these products could perform all of the important functions of controlling the flow of the stored fluid, preventing inadvertent or accidental flow of stored fluid, permitting the flow of vapors or gasses from the fluid in the container to the applicator tip while simultaneously preventing the flow of stored fluid through the applicator, and preventing drying out of the applicator tip after use or during periods of nonuse.

In the use of highly volatile fluids such as nail enamels, volatile paints, and correction fluid, the volatile fluid product is generally sealed in an air tight container. For application of such fluids directly from the sealed container, some pen type devices are marketed that permit the passage of these fluids through an applicator tip and include a check valve which is connected to the applicator tip. The check valve is opened by applying sufficient pressure to the tip and, when the pressure is released from the tip, the check valve closes. The valve thus acts as a shut off valve, the purpose of which is to prevent air from getting into the container and thereby preventing the product from drying out. Additionally, the shut off valve prevents the unintended release of the contained product by inadvertent squeezing or activation of the tube that contains the stored fluid. This shut-off valve design requires, however, that the applicator tip be made of a relatively hard substance such as metal. This arrangement is used, for example, in Pentel and Gillette correction fluid pens.

Another version of this type of shut-off valve design is used in the application of paints from a Tester's paint pen, and in the application of nail enamel from nail enamel pens marketed by Aziza and Margaret Astor. These devices use a fibre tip or porous plastic applicator.

A significant problem with these designs of shut-off valve type prior art devices is that the tip becomes damaged from repeated use as a result of the pressure that is required to open the shut-off valve, damage which adversely affects the functioning and use of the device.

Another problem is that once the product is used and a cap is placed on the applicator, any remaining fluid on the applicator quickly dries out and hardens, also adversely affecting subsequent use of the applicator.

The use of a soft or bristled application brush as the applicator tip is not possible with these constructions of shut-off valve type devices because the soft brush cannot withstand the pressure that is required to open the check valve. Yet products such as nail polish and the like cannot be effectively or satisfactorily applied to a work surface without a bristled brush or a similar soft and flexible applicator.

Attempts to overcome the rapid drying-out of the applicator tip have focussed on the use of a solvent cap, which requires that a solvent be placed or stored in the cap to saturate the applicator tip and thereby prevent its drying out when the cap is in place over the applicator. This introduces another problem because each time the cap is removed, solvent escapes from the cap so that the user must periodically replenish the supply of solvent. A prior art brush-on nail enamel pen product marketed by Beecham Cosmetics and developed by Schwan Stabillo used this approach and failed in the marketplace.

SUMMARY OF THE INVENTION

The applicator and fluid storage container of the present invention is accordingly constructed to provide the multiple functionality of controlling the flow of stored product from the container through an applicator having an associated detachably removable container cap, whereby when the cap is removed, stored fluid is permitted to flow from the container through the applicator tip and when the cap is replaced, fluids are prevented from flowing through the tip; preventing stored fluid flow from the container to and through the applicator tip as a result of inadvertent or accidental squeezing of the container when the cap is in place; permitting the flow of vapors or gasses from the stored fluid in the container through the applicator tip and simultaneously preventing stored fluid flow through the applicator; and preventing drying out of the applicator tip when it is capped by capturing the solvents released from the container in the cap, thereby immersing the applicator tip in a continuous solvent atmosphere.

Other features of the present invention will become apparent from the following detailed description considered in conjunction with the accompanying drawings. It is to be understood, however, that the drawings are designed and intended solely for purposes of illustration and not as a definition of the limits of the invention, for which reference should be made to the appended claims.

BRIEF DESCRIPTION OF THE DRAWINGS

In the drawings, wherein like reference numerals denote similar elements throughout the several views.

DETAILED DESCRIPTION OF THE PREFERRED EMBODIMENTS

Figure 1A:
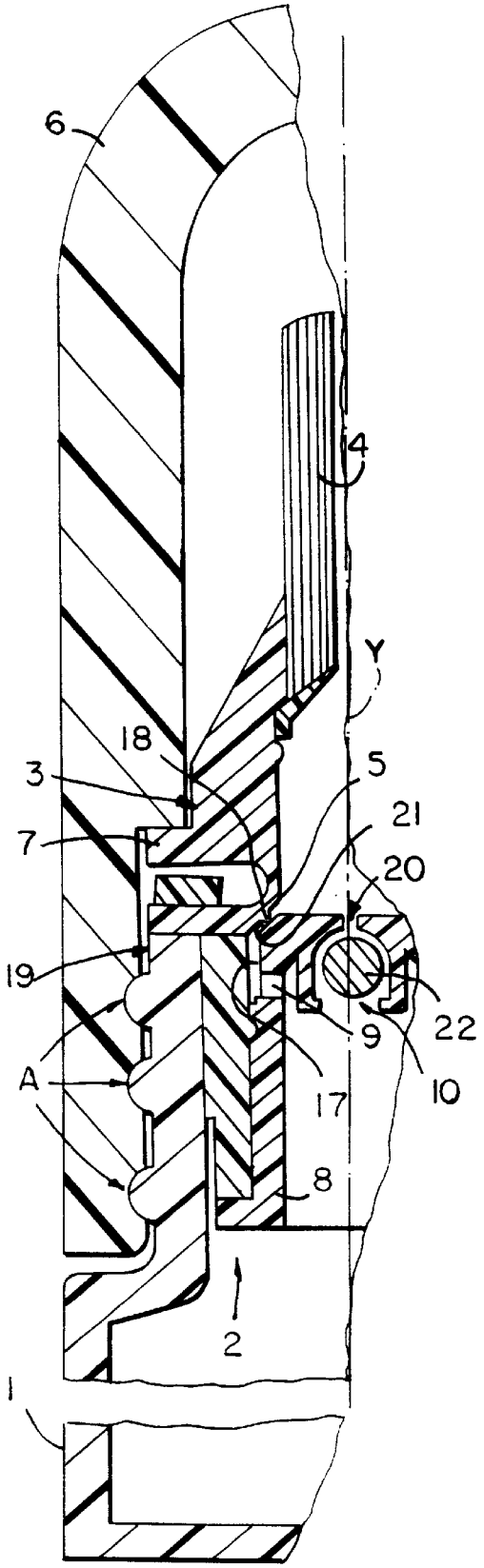
FIGS. 1A and 1B are sectional views along the longitudinal axis of an embodiment of the fluid dispenser of the present invention showing both the open and closed positions of the closure system.
Figure 1B:
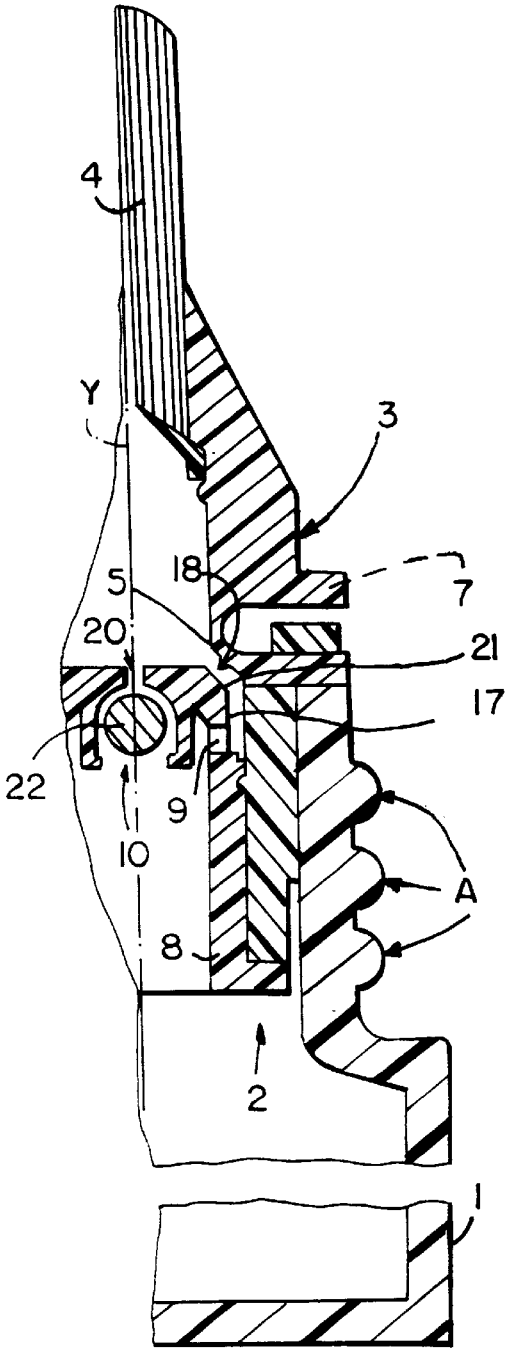

With initial reference to FIGS. 1A and 1B, a fluid applicator and dispensing system for controlling fluid flow and vapor flow includes a container 1 holding a supply of a stored fluid and having an opening or open end 2. The fluids generally intended for use with the design of this invention are flowable volatile fluids such as nail enamels, paints, and correction fluids. However, any other liquid fluid may also be used, including those having significantly higher viscosities. In general, any non-gaseous fluid may be used with the present invention. The container 1 is formed of a material having properties sufficient to hold the stored liquid and sufficiently resiliently flexible to accommodate the radially inward deformation of its peripheral wall or wall portion(s) by which the selective dispensing of stored fluid from the applicator under the manual control of the user is carried out. Suitable materials include polyvinylchloride (PVC), polyethylene, polyolefin and, as is preferred where particularly volatile fluids are to be stored, a barrier plastic commercially available under the name Barex.

The open end 2 of container 1 receives and retains, by friction fit or non-releasable securement, an end of an applicator housing 3 which may optionally be formed as an integral or unitary part of the container 1. Another or opposite end of the applicator housing 3, which is remote from the opening 2, carries an applicator or device for applying the stored fluid to a workpiece or surface, such as a bristled brush 4 which may, by way of preferred example, be configured and formed in accordance with the brushes and methods of making same disclosed in one or more of U.S. Pat. Nos. 4,908,902, 4,907,841, 4,968,103, and 4,974,908, the entire disclosures of which are incorporated herein by reference.

FIGS. 1A and 1B also show an insert 8 non-movably disposed in the applicator housing 3 at or proximate the open end 2 of container 1. The insert 8 forms peripheral passages 17 defined between insert 8 and applicator housing 3 for accommodating, through such passages, the flow of stored fluid from the container 1 to the applicator housing 3 and onto brush 4. The insert 8 also includes ports 9 that extend from its open central hollow to its outer periphery to provide fluid communication pathways between the open end 2 of container 1 and the peripheral passages 17.

At or proximate to an upper portion of the passages 17, insert 8 includes an angled surface 21 at the location and forming a boundary portion of each passage 17. Directly opposing the angled surface 21 at each of the passages 17, a rib or sealing strip 18 projects radially inwardly toward the angled surface 21 from a thin-walled portion 5 of the applicator housing 3 located in confronting opposition to the angled surface 21. The normal spacing or clearance between the angled surface 21 and the sealing strip 18 define an opening through which stored fluid passes as it flows or moves from the container 1 to the applicator brush 4. Immediately above (in FIGS. 1A and 1B) thin-walled portions 5, tabs 7 project radially outward from the outer periphery of the applicator housing 3 transverse to the longitudinal axis of the applicator housing. When one or a combination of downward (in FIG. 1A) and radially-inward pressure is exerted on the tabs 7 by, as hereinafter described, an associated closure cap 6, the tabs 7 are downwardly and/or inwardly displaced and the thin-walled portions 5 are thereby deformed to displace the ribs or sealing strips 18 toward the opposed angled surfaces 21. As this displacement of the tabs and deformation or shifting of the thin-walled portions 5 continues, the sealing strips 18 move into passage-closing or sealing abutment or contact with the opposed angled surfaces 21 to close the upper portions of the passages 17 against fluid flow from the container 1 to brush 4. This construction thus functions as and defines a shut-off valve that automatically and selectively closes the fluid flow passages 17 through application of a downward force and/or radially-inward against tabs 7. The applicator housing may, by way of example, be formed of a polyolefin plastic.

It will be appreciated that the exact arrangement and configuration of the elements forming the flow passages 17 and associated shut-off valves for selectively closing the passages 17 may be modified from the arrangement shown in FIG. 1, as a general matter of design choice, in a number of ways that will be apparent to persons of ordinary skill. For example, the insert 8 may be formed so as to define a continuous, annular clearance between its outer periphery and the inner periphery of the container open end in the area of passages 17 and thereby provide a single annular passageway 17 extending about the insert 8 and communicating with a plurality of ports or throughbores or passways 9. In such a modification, the insert will include a single annular angled surface 21 and the applicator housing 3 will carry at least one annular rib or sealing strip 7 in confronting opposition and moveable into passageway-sealing contact with the surface 21. To further facilitate sealing of the passageway 17, a single annular tab 7 may be defined on and about the applicator housing 3 for radially inwardly and/or downwardly (in FIG. 1A) directed displacement by the associated cap 6 when, as explained below, the cap 6 is moved into applicator-closing position over the brush and applicator housing. This and like modifications are within the intended scope and contemplation of the invention.

The cap 6 is detachably placable and retainable over the brush-type applicator 3 through threaded engagement of the cap 6 with the threaded outer surface 19 of the open end 2 of container 1. The inner periphery of cap 6 is radially inwardly stepped at a predetermined distance above threads A for abutment with and against the tabs 7 as the cap is threadedly engaged with the applicator housing or dispenser body to fluid-tightly cover the brush 4. As shown in FIG. 1A, in the fully engaged or seated position of the cap the tabs 7 are displaced to an extent sufficient to deform the thin-walled portion 5 so that the sealing strips or ribs 18 are moved into abutment with the angled surface 21 to close or seal the passages 17 and thereby prevent the flow of stored fluid from the container 1 to the applicator housing 3 and brush 4 through the passages 17. When the cap 6 is on the other hand removed from about the brush-carrying end of the disposer (see FIG. 1B), the movable thin walled portions 5 resiliently return to their original or undefined position under the natural return urgency of the material of which the applicator housing 3 is constructed. In this original or open position, the sealing strips 18 of the movable thin-walled portions 5 are again displaced from the angled surface 21 to thus permit the flow of stored fluid from the container 1 to the applicator housing 3 through passages 17, and onto brush 4.

Insert 8 further includes a ball-type check valve 10. The valve 10 is defined by a narrow passage 20 which connects the container 1 and applicator housing 3 and having a preferred width in the range of about 0.005" to 0.0075", and an associated ball 22 that is captured in a partially-enveloping cage for restricted movement into and out of sealing contact with the adjacent end of passage 20. The narrow passage 20 is sized to allow vapors from the stored fluid in container 1 to escape from the container 1 and flow to the applicator housing 3 through brush 4 and into the area enclosed and bounded by cap 6 when the cap is disposed in its dispenser-closing position about the brush. In this condition, if the container 1 is inadvertently or unintendedly squeezed, the ball 22 of valve 10 is urged against and closes the narrow passage 20 as a result of the increased pressure in the container 1 produced by the temporary reduction in its volume. This closure prevents the flow of stored liquid into the applicator housing through passage 20. Accordingly, the check valve 10 permits volatile solvent and other vapors to flow into the area enclosed by the cap 6 to prevent drying of the brush 4, while preventing the unintentional or inadvertent discharge of stored fluid from container 1 when the cap 6 is disposed or seated in sealing position about the applicator end of the dispenser.

To use the fluid applicator and dispensing system of the invention, the cap 6 is removed from about the applicator housing 3 and the container 1 is squeezed by user application of radially inwardly-directed pressure in the peripheral sidewall of the container 1 to dispense stored fluid from container 1. The fluid flows through the ports 9 and open passageways 17 into applicator housing 3 and onto the brush 4, from which it may be selectively applied to the intended surface. During this process, the ball 22 of valve 10 is urged toward and moved against the narrow passage 20 to close the passage 20 under the increased container pressure, thereby preventing the flow or delivery of fluid from container 1 through passage 20 of valve 10. After the normal dispensing of the stored fluid through passageways 17 is completed and the user releases the inwardly-directed pressure on the sidewall of container 1, a momentary negative pressure is created in container 1 as the container wall returns to its original form, thus opening the ball valve 10 and returning it to its normal state. Any remaining fluid in the applicator housing 3 is sucked back into container 1 by the momentary negative pressure.

When the cap 6 is fully seated and secured at threads A onto and about the outer surface 17 of the container open end 2, it forms a fluid-tight seal about the container open end and within which the brush 4 is enclosed. The flow of solvent vapors from the stored fluid in container 1 through the passage 20 of ball valve 10, into the applicator housing 3 and through brush 4 into the cap 6 creates a solvent atmosphere within the cap which prevents drying out of the brush 4 during periods of nonuse.

FIGS. 2A, 2B, 3A, 3B, 4A and 4B show various modified or alternative embodiments of the inventive fluid dispenser. For brevity and convenience, only those portions or elements or features or aspects of the dispenser that have been modified from embodiment-to-embodiment will be described, and it should be understood that all of the herein-described modifications, singlely or in combination, in each of these embodiments may be applied to any or all of these embodiments as general matters of design choice and within the intended scope of the invention.

Figure 2A:
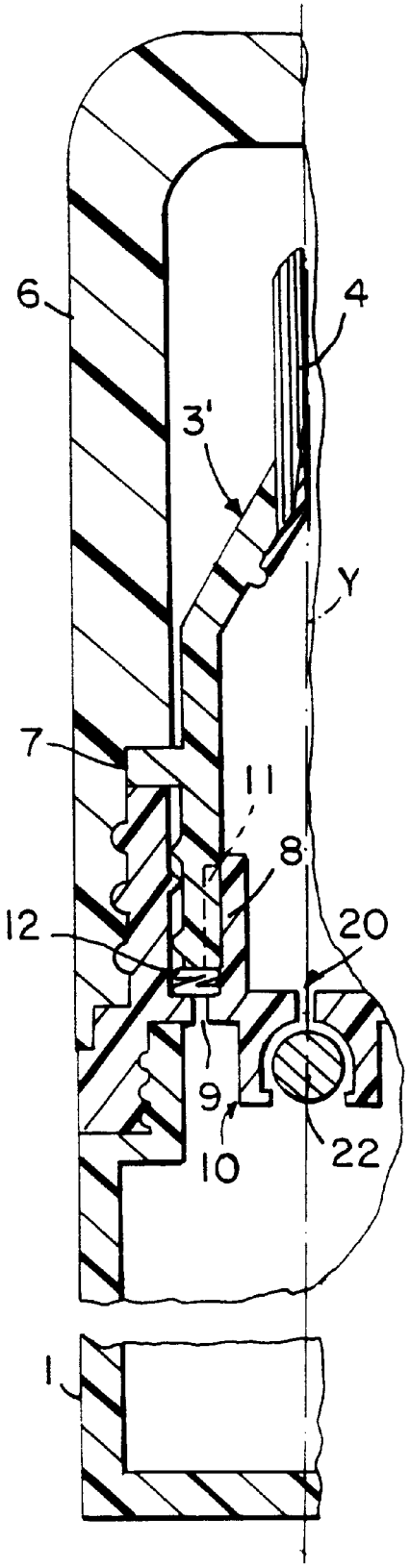
FIGS. 2A and 2B are sectional views along the longitudinal axis of another embodiment of the fluid dispenser of the present invention showing both the open and closed positions of the closure system.
Figure 2B:
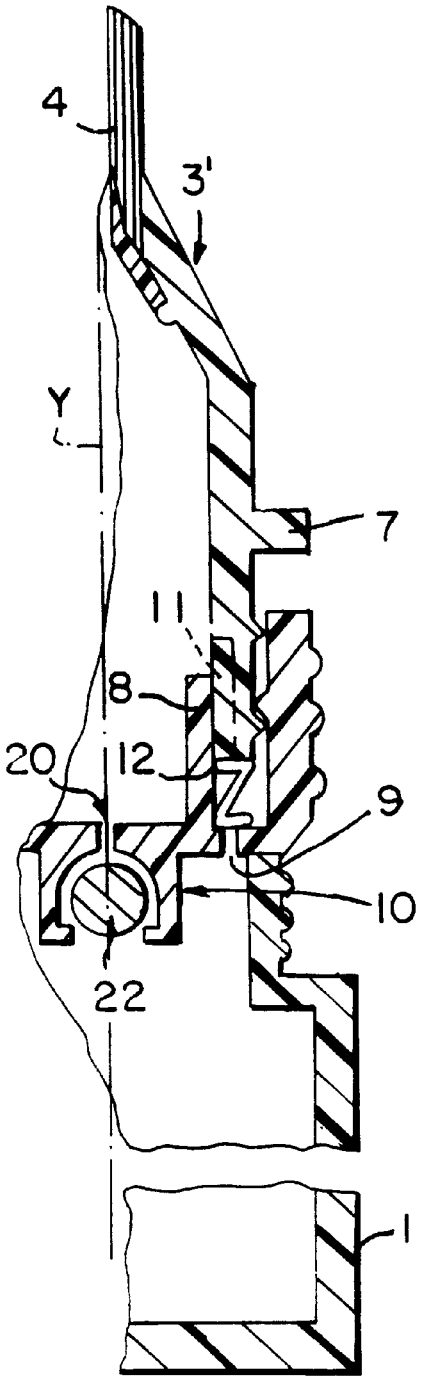

FIGS. 2A and 2B depicts an embodiment of the invention in which the applicator housing 3' omits the thin wall-portion(s) 5 and the rib(s) or sealing strip(s) 18 projecting therefrom for displaceable engagement with the angled surface(s) 21 as in the embodiment of FIG. 1. This modified form of dispenser may be example be employed where it is desired to dispense a particularly volatile fluid product, such as those which contain acetone, and in which suitable barrier plastics and the like do not readily or effectively provide the desired flexible deformability of the thin-wall portion(s) needed to implement the applicator housing construction and functionality of the embodiment of FIGS. 1A and 1B. In this modified embodiment, the cap-induced application of downward force to the tabs 7 downwardly shifts or displaces the entire applicator housing 3' against the return memory of springs 12. Thus, in lieu of the passages 17 shown in FIGS. 1A and 1B, applicator housing 3' has longitudinally directed blind channels 11 defined along a lower portion of its interior wall periphery for accommodating the flow of fluid from container 1 into applicator housing 3'. When the applicator is in its dispensing condition shown FIG. 2B, at least an upper portion of the blind channels 11 rises above the insert 8 to allow the flow of stored fluid from container 1 through blind channel 11 into applicator housing 3' and onto the brush 4. As the cap 6 is threaded onto the dispenser, it forces the downward displacement of the tabs 7 against the urgency of springs 12 whereby the applicator housing 3' is downwardly displaced. In the fully seated position of the cap shown in FIG. 2A, the channels 11 are closed along their entire lengths by the abutting outer periphery of the insert 8 to create a sealing contact that prevents the flow of stored fluid from container 1 into applicator housing 3'. As in the embodiment of FIGS. 1A and 1B, the ports 9 in insert 8 provide fluid communication paths between the open end of the fluid container and the blind channels 11.

Figure 3A:
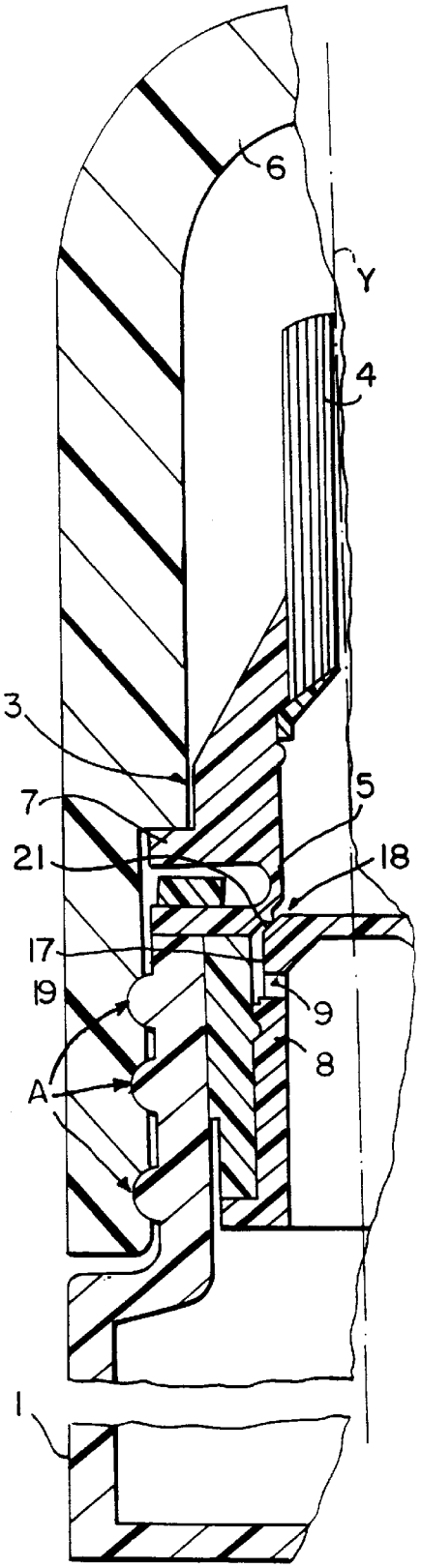
FIGS. 3A and 3B are sectional views along the longitudinal axis of still another embodiment of the fluid dispenser of the present invention showing both the open and closed positions of the closure system.
Figure 3B:
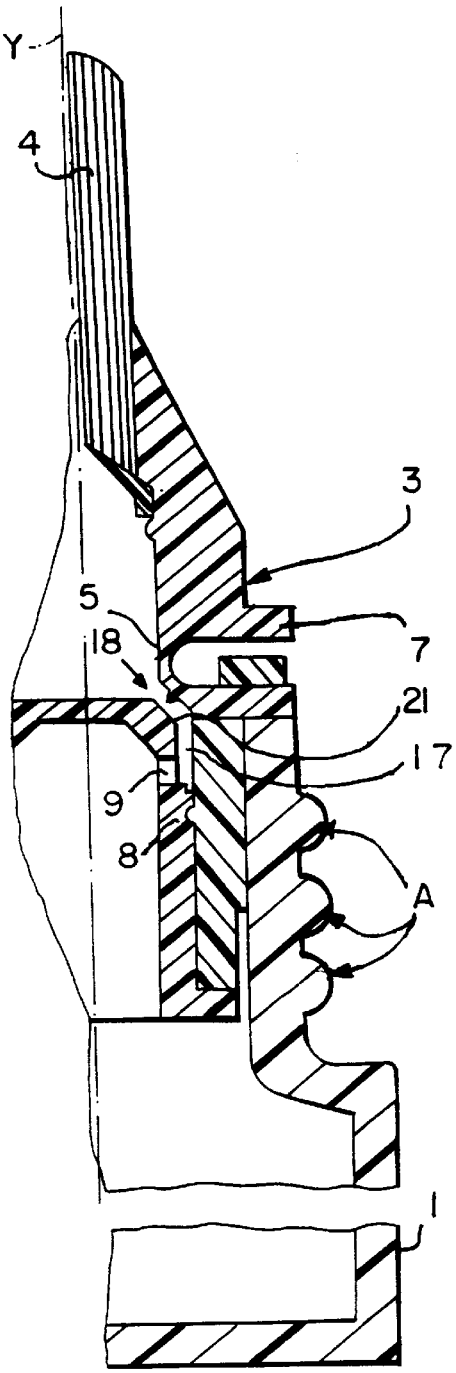

FIGS. 3A and 3B shows an embodiment similar to that of FIGS. 1A and 1B but omitting the ball valve 10. This provides a less costly form of the inventive fluid applicator which may for example be employed with non-volatile fluids in which rapid drying out of the brush is at least less of a problem.

Figure 4A:
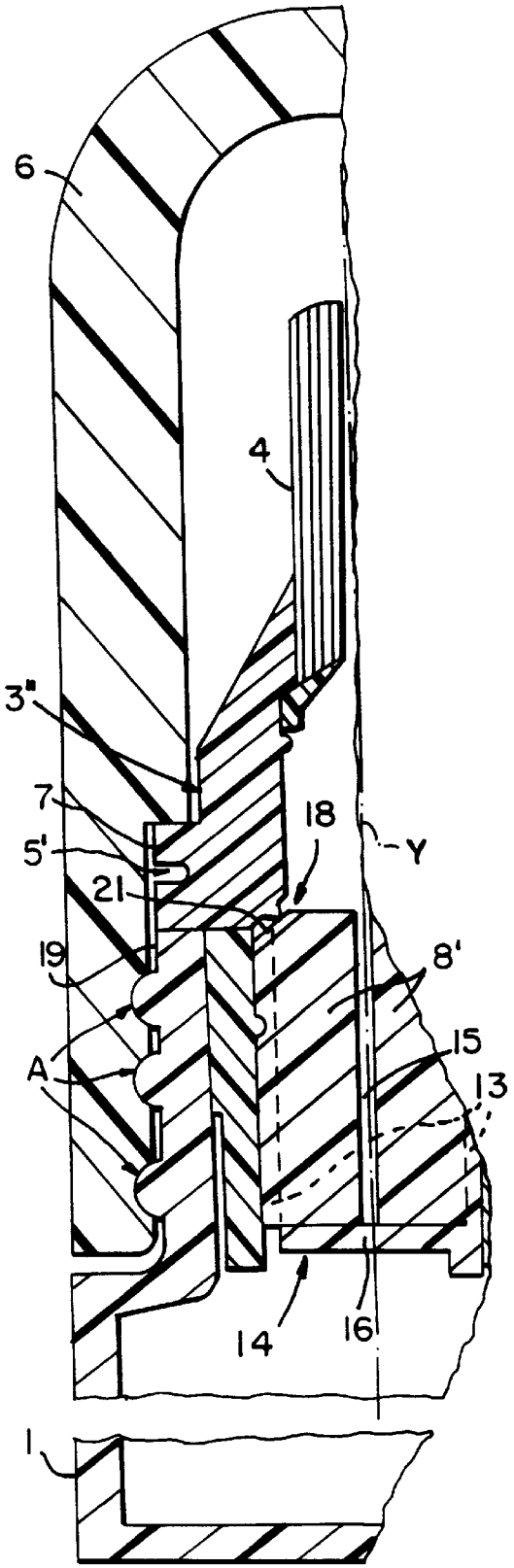
FIGS. 4A and 4B are sectional views along the longitudinal axis of yet another embodiment of the fluid dispenser of the present invention showing both the open and closed positions of the closure system.
Figure 4B:
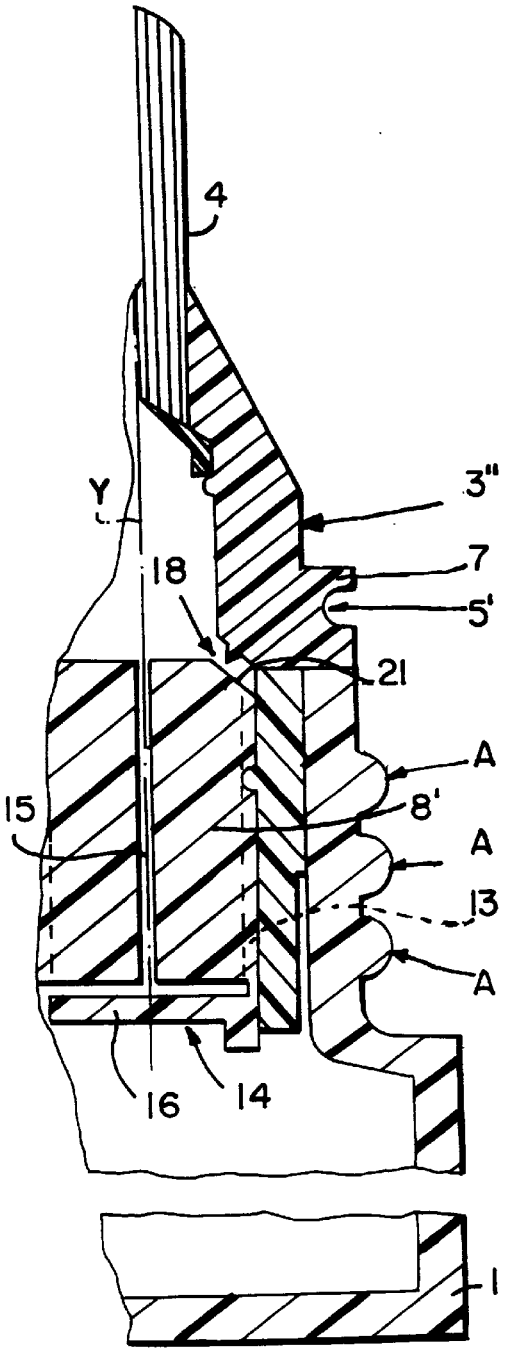

FIGS. 4A and 4B depict another embodiment of the present invention in which the insert 8' has been modified from that shown in FIGS. 1A and 1B. The insert 8' is fixedly secured in the lower portion of applicator housing 3" and defines fluid flow passages or channels 13 between insert 8' and applicator housing 3" for accommodating therethrough the flow of stored fluid from container 1 into the applicator housing. Although applicator housing 3" omits the thin-walled portion(s) 5 of the embodiment of FIGS. 1A and 1B, it is nevertheless formed and configured for sufficient resilient flexibility so that, when the cap 6 is threadedly engaged with and tightened down about the open end 2 of container 1, the cap displaces the tab(s) 7 and thereby deforms that portion of the applicator housing wall from which the rib(s) or sealing strip(s) 18 project into passage-closing abutment with the opposed angled wall surface(s) 21 of insert 8'.

The embodiment of FIGS. 4A and 4B also includes, in place of the ball-type valve 10 of the FIGS. 1A and 1B embodiment, a flapper-type valve 16 that is moveable to open and close the passageway 15 that extends longitudinally through insert 8'. The passageway 15 has a preferred diameter in the range of about 0.005" to 0.0075" for passing therethrough vapors that are emitted from the stored fluid in container 1.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

What is claimed is:

1. A hand-held dispenser for user-controlled delivery of a stored fluid onto a work surface, comprising:

a container having a storage portion for containing a supply of stored fluid and an applicator portion, said container portion including a flexible wall portion selectively deformable by a user for delivering stored fluid from the dispenser;

an applicator carried on the applicator portion for receiving stored fluid from the applicator portion for user-controlled delivery of fluid onto a work surface;

an insert disposed in said container between the storage portion and the applicator portion and defining a passage between said insert and applicator portion for accommodating flow of stored fluid from the storage portion to the applicator portion through said passage;

sealing means on one of said applicator portion and said insert and movable relative to the other of said applicator portion and said insert from a first position in which said sealing means closes said passage against flow of stored fluid through said passage and a second position in which said sealing means is disposed so that said passage is open for delivery of stored flow from the container portion to the applicator portion through said passage;

said applicator portion being moveable relative to said insert to relatively move said sealing means between said first and second positions;

a cap for detachably engaged positioning in a fully seated condition about said applicator portion and said applicator to sealingly enclose said applicator within said cap; and said applicator portion further comprising an operating tab for engagement with said cap and configured for moving said applicator portion relative to said insert to relatively move said sealing means from said second to said first position of the sealing means as said cap is advanced into said fully seated condition about said applicator portion and applicator to thereby close said passage and thereby prevent the flow of stored fluid from said container portion to said applicator portion when the cap is fully seated about said applicator portion and applicator, and for accommodating said relative movement of the sealing means from said first to said second position of the sealing means as said cap is detached from engagement about said applicator portion and applicator to open said passageway and permit the flow of stored fluid from said container portion to said applicator portion and onto said applicator for user-controlled delivery onto a work surface;

a vapor-discharge passageway defined in and through said insert for release of vapors from said storage portion to said applicator portion; and a pressure-activated check valve in said container portion for closing said vapor-discharge passageway when said container portion wall portion is selectively deformed for delivery of stored fluid from the dispenser.

2. The dispenser of claim 1, wherein said sealing means further comprises a sealing strip on said applicator portion positioned at one end of said passage and an angled surface on said insert at the one end of said passage and across from said sealing strip so that when said sealing means is moved to said first position, said sealing strip is urged against said angled surface and when said sealing means is moved to said second position, said sealing strip is remote from said angled surface for delivery of stored fluid therebetween.

3. The dispenser of claim 2, wherein said passage comprises a bore through said insert.

4. The dispenser of claim 2, wherein said passage comprises a bore through said insert and a blind channel on a surface of said applicator portion.

5. The dispenser of claim 1, wherein said passage comprises a blind channel on said applicator portion.

6. The dispenser of claim 5, wherein the sealing means further comprises a surface on said insert, wherein said surface is positioned for blocking the passage when said applicator portion is moved to the first position and wherein said blind channel bypasses said surface when said applicator portion is in said second position.

7. The dispenser of claim 1, wherein said pressure-operated check valve comprises a ball-type check valve.

8. The dispenser of claim 1, wherein said pressure-operated check valve comprises a flapper-type check valve.

9. The dispenser of claim 1, wherein said storage portion and said applicator portion comprise one integral portion.

10. The dispenser of claim 1, wherein said container is made from a material comprising one of polyvinylchloride, polyethylene, polyolefin, and Barex.

11. The dispenser of claim 1, wherein said vapor-discharge passageway comprises a width in the range from 0.005" to 0.0075".

12. The dispenser of claim 1, wherein said applicator comprises a deformable thin-walled portion being sufficiently deformable for allowing said sealing means to move between said first position and said second position.

13. A fluid dispenser for containing and dispensing fluid, comprising:

a container comprising a storage portion for holding a stored fluid, an applicator portion having an applicator for receiving the stored fluid for user-controlled application of said stored fluid to a surface, and a resilient connection connecting said storage portion to said applicator portion so that said applicator portion is movable between a first position and a second position relative to said storage portion;

said storage portion comprising a flexible wall selectively deformable for dispensing said stored fluid to said applicator;

an insert arranged in said storage portion of said container proximate said resilient connection and defining a passage area for conducting the stored fluid between said storage portion and said applicator;

said insert further comprising a vapor-discharge passageway for releasing vapors from said storage portion to said applicator portion;

a sealing element arranged on one of said insert and said applicator portion so that said sealing element closes said passage area when said applicator portion is in the first position thereby preventing the flow of fluid from said storage portion to said applicator and said sealing element opens said passage area when said applicator portion is in the second position thereby allowing the flow of fluid through said passage area; and a cap being detachably engagable with said storage portion in a fully seated position for sealably enclosing said applicator and holding said applicator portion in said second position.

14. The fluid dispenser of claim 13, wherein said resilient portion urges said applicator portion toward said second position so that said applicator portion assumes said second position when said cap is removed from said storage portion.

15. The fluid dispenser of claim 14, wherein said storage portion, said applicator portion, and said resilient portion comprise one integral piece of material.

16. The fluid dispenser of claim 15, wherein said resilient portion comprises a thin-walled area of said piece of material.

17. The fluid dispenser of claim 14, wherein said resilient portion comprises a spring.

18. The fluid dispenser of claim 13, further comprising a pressure activated check valve for closing said vapor-discharge passageway when said flexible wall of said storage portion is selectively deformed for dispensing said stored fluid to said applicator.

19. The fluid dispenser of claim 13, wherein said sealing element comprises a sealing strip on said applicator portion positioned at one end of said passage area and said insert comprises an angled surface at the one end of said passage area and across from said sealing strip so that when said applicator portion is moved to said first position, said sealing strip is urged against said angled surface and when said applicator portion is moved to said second position, said sealing strip is remote from said angled surface for allowing delivery of stored fluid through said passage area.

20. The dispenser of claim 19, wherein said passage area comprises a bore through said insert.

21. The dispenser of claim 19, wherein said passage area comprises a bore through said insert and a blind channel on a surface of said applicator portion.

22. The dispenser of claim 13, wherein said passage comprises a blind channel on said applicator portion.

23. The dispenser of claim 22, wherein said sealing element further comprises a surface on said insert, wherein said surface is positioned for blocking said passage area when said applicator portion is moved to the first position and wherein said blind channel bypasses said surface when said applicator portion is in said second position.

24. The dispenser of claim 13, wherein said vapor-discharge passageway comprises a width in the range from 0.005" to 0.0075".

* * * * *